US010777976B1

(12) United States Patent
Gozawa et al.

(10) Patent No.: US 10,777,976 B1
(45) Date of Patent: Sep. 15, 2020

(54) SPARK PLUG

(71) Applicant: NGK SPARK PLUG CO., LTD., Nagoya-shi, Aichi (JP)

(72) Inventors: Tatsuya Gozawa, Nagoya (JP); Kenji Ban, Nagoya (JP); Daiki Goto, Nagoya (JP)

(73) Assignee: NGK SPARK PLUG CO., LTD., Nagoya-shi (JP)

( * ) Notice: Subject to any disclaimer, the term of this patent is extended or adjusted under 35 U.S.C. 154(b) by 0 days.

(21) Appl. No.: 16/848,289

(22) Filed: Apr. 14, 2020

(30) Foreign Application Priority Data

May 7, 2019 (JP) ..... 2019-087418

(51) Int. Cl.

| | |
|---|---|
| ***H01T 13/39*** | (2006.01) |
| ***H01T 13/32*** | (2006.01) |
| ***H01T 21/02*** | (2006.01) |
| ***H01T 13/52*** | (2006.01) |
| ***H01T 13/06*** | (2006.01) |

(52) U.S. Cl.
CPC ..... *H01T 13/39* (2013.01); *H01T 13/06* (2013.01); *H01T 13/32* (2013.01); *H01T 13/52* (2013.01); *H01T 21/02* (2013.01)

(58) Field of Classification Search
CPC ..... H01T 13/39; H01T 13/06; H01T 13/32; H01T 13/52; H01T 21/00; H01T 21/02
See application file for complete search history.

(56) References Cited

U.S. PATENT DOCUMENTS

| | | | | |
|---|---|---|---|---|
| 8,912,716 | B2 | 12/2014 | Hwang et al. | |
| 2012/0240890 | A1* | 9/2012 | Johng | F02P 13/00 123/169 P |
| 2012/0242215 | A1 | 9/2012 | Hwang et al. | |
| 2012/0299459 | A1* | 11/2012 | Sakakura | H01T 13/467 313/141 |
| 2014/0225497 | A1* | 8/2014 | Woerner | F02P 23/04 313/143 |
| 2020/0036166 | A1* | 1/2020 | Kuhnert | H01T 21/02 |

FOREIGN PATENT DOCUMENTS

| | | | | |
|---|---|---|---|---|
| JP | 2009270542 | A * | 11/2009 | |
| JP | 2012-199236 | A | 10/2012 | |
| JP | 2017101647 | A * | 6/2017 | F02B 19/12 |
| JP | 2017103179 | A * | 6/2017 | |
| WO | WO-2019065053 | A1 * | 4/2019 | F02B 19/16 |

* cited by examiner

*Primary Examiner* — Mariceli Santiago
(74) *Attorney, Agent, or Firm* — Kusner & Jaffe

(57) ABSTRACT

A spark plug wherein the occurrence of pre-ignition and misfires is suppressed. The spark plug includes a cover portion that covers a front end portion of a center electrode and a facing portion of a ground electrode from a front end side of the spark plug to form a pre-chamber space. The cover portion has injection holes that are through-holes. A total area A ($mm^2$) of inner peripheral surfaces of the injection holes and a thermal conductivity B (W/mK) of a material of the cover portion satisfy a formula (1): $10<A\times B<4000$.

6 Claims, 3 Drawing Sheets

SPARK PLUG

FIELD OF THE INVENTION

The present invention relates to a spark plug.

BACKGROUND OF THE INVENTION

Spark plugs including an ignition chamber have been developed. For example, a pre-chamber ignition plug according to Japanese Unexamined Patent Application Publication No. 2012-199236 ("PTL 1") includes a cylindrical metal housing, and an ignition chamber cap that surrounds a center electrode and a ground electrode to form an ignition chamber. The ignition chamber cap has multiple orifices that allow an air-fuel mixture to flow into the ignition chamber from a combustion chamber. This ignition plug ignites in the ignition chamber, and injects torch-shaped flames into the combustion chamber through the orifices to burn an air-fuel mixture in the combustion chamber.

The ignition plug disclosed in PTL 1, however, has a structure where the ignition chamber is closed except for the orifices. Thus, the temperature inside the ignition chamber tends to rise at the ignition, which may cause pre-ignition. On the other hand, in this ignition plug, an amount of combustion gas that enters the ignition chamber is small, and cooling around the ignition chamber progresses due to, for example, heat conduction to the cylinder head, which may cause misfires.

SUMMARY OF THE INVENTION

The present invention has been made in view of the above-described circumstances, and aims to suppress occurrence of pre-ignition and misfires in a spark plug including a cover portion that forms a pre-chamber. The present invention can be embodied in the following forms.

(1) A spark plug includes a center electrode, a ground electrode that includes a facing portion facing a front end portion of the center electrode and forms a discharge gap between the facing portion and the front end portion of the center electrode, a cylindrical insulator that accommodates the center electrode therein with the front end portion of the center electrode being exposed from a front end of the insulator, a metal shell that accommodates the insulator therein, and a cover portion that covers, from a front end side of the spark plug, the front end portion of the center electrode and the facing portion of the ground electrode to form a pre-chamber, the cover portion including injection holes that are through-holes. A total area A ($mm^2$) of inner peripheral surfaces of the injection holes and a thermal conductivity B (W/mK) of a material of the cover portion satisfy a formula (1):

$$10<A\times B<4000 \quad \text{formula (1).}$$

In a spark plug according to an aspect of the present invention, as the total area A ($mm^2$) of inner peripheral surfaces of the injection holes increases, heat in the pre-chamber is more likely to be transferred from the cover portion toward the metal shell side. As the thermal conductivity B (W/mK) of the material of the cover portion increases, heat in the pre-chamber is more likely to be transferred from the cover portion toward the metal shell side. Therefore, when A×B is set to be smaller than 4000, heat is not excessively transferred from the cover portion toward the metal shell side, so that misfires due to lowering of temperature of the cover portion can be prevented. In addition, when A×B is set to be larger than 10, heat transfer from the cover portion toward the metal shell side is facilitated, so that pre-ignition can be prevented.

(2) In the spark plug described in (1), the total area A ($mm^2$) and the thermal conductivity B (W/mK) satisfy a formula (2):

$$20<A\times B<2400 \quad \text{formula (2).}$$

In this spark plug, when the product of A×B is set to be larger than 20, where A is the total area ($mm^2$) of the inner peripheral surfaces of the injection holes and B is the thermal conductivity (W/mK) of the material of the cover portion, heat transfer from the cover portion toward the metal shell side is further facilitated, so that pre-ignition can be more efficiently prevented.

(3) In the spark plug described in (1) or (2), when the inner peripheral surface of at least one of the injection holes having a center axial line inclined with respect to an axial line of the spark plug is cut by a plane P, a portion inside the injection hole on the front end side with respect to the plane P has a smaller surface area than a portion inside the injection hole on a rear end side with respect to the plane P, where the plane P is a plane that passes the center axial line of the injection hole and is orthogonal to a plane including the axial line of the spark plug and the center axial line of the injection hole.

In this spark plug, heat is more likely to be guided to be dissipated from the front end side of the cover portion to the rear end side in an environment where pre-ignition easily occurs. Therefore, temperature does not rise excessively, so that pre-ignition can be prevented.

(4) In the spark plug described in (1) or (2), when the inner peripheral surface of at least one of the injection holes having a center axial line inclined with respect to an axial line of the spark plug is cut by a plane P, a portion inside the injection hole on the front end side with respect to the plane P has a larger surface area than a portion inside the injection hole on a rear end side with respect to the plane P, where the plane P is a plane that passes the center axial line of the injection hole and orthogonal to a plane including the axial line of the spark plug and the center axial line of the injection hole.

In this spark plug, heat is more likely to be guided to be collected to the front end side of the cover portion in an environment where misfires easily occur. Therefore, temperature is not easily lowered, so that misfires can be prevented.

DETAILED DESCRIPTION OF THE INVENTION

First Embodiment

Hereinafter, a first embodiment of a spark plug 100 will be described in detail with reference to the drawings. In the following description, the lower side in FIG. 1 is referred to as a front end side (front side) of the spark plug 100, and the upper side in FIG. 1 is referred to as a rear end side of the spark plug 100.

Figure 1:
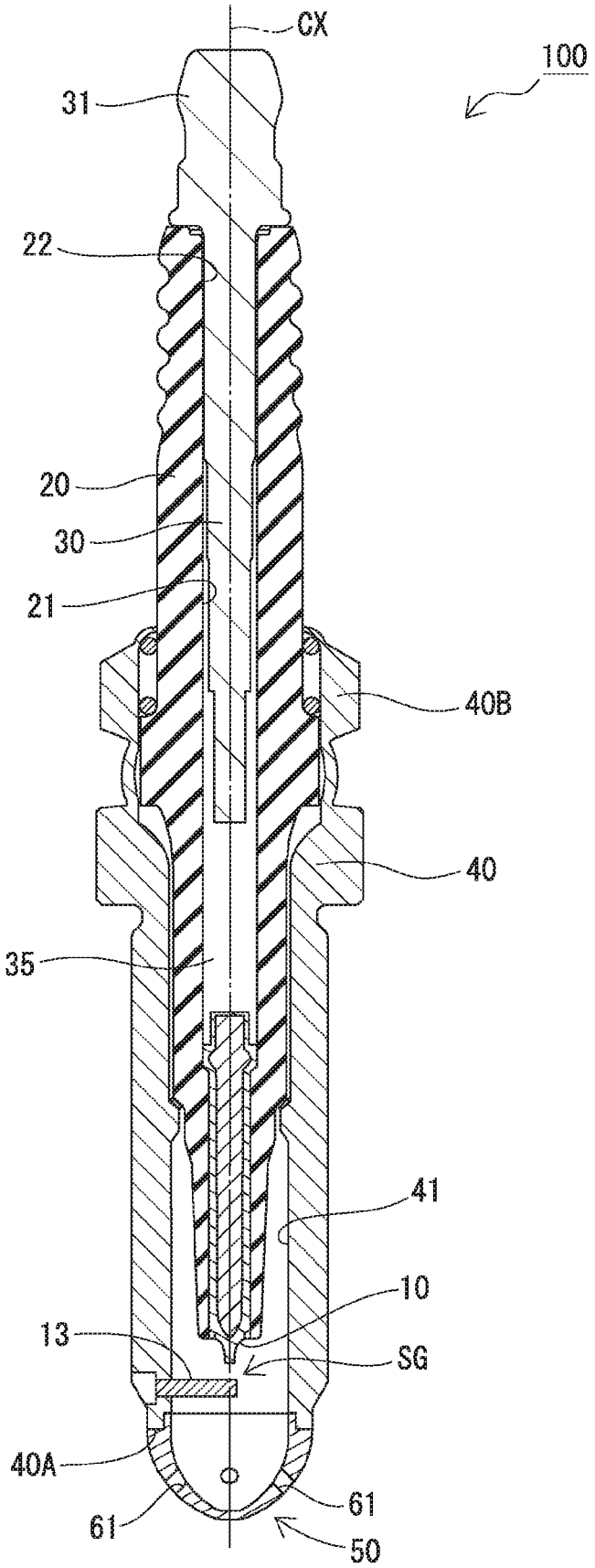
FIG. 1 is a cross-sectional view of a structure of a spark plug according to a first embodiment.

FIG. 1 is a cross-sectional view of a schematic structure of the spark plug 100 according to the first embodiment, in FIG. 1, a center axial line CX of the spark plug 100 (an axial line of the spark plug) is drawn with a dot-and-dash line.

The spark plug 100 is mounted on an internal combustion engine and used to ignite an air-fuel mixture in a combustion chamber. When mounted on the internal combustion engine, the front end side of the spark plug 100 (lower side in the drawing) is disposed inside the combustion chamber of the internal combustion engine, and the rear end side (upper side in the drawing) is disposed outside the combustion chamber. The spark plug 100 includes a center electrode 10, a ground electrode 13, an insulator 20, a terminal electrode 30, and a metal shell 40.

The center electrode 10 is constituted by a shaft-shaped electrode member and disposed in such a manner that a center axis thereof is coincident with the center axial line CX of the spark plug 100. The center electrode 10 is held by the metal shell 40 with the insulator 20 interposed therebetween in such a manner that a front end portion 11 is positioned on the rear end side (upper side in the drawing) with respect to a front-end-side opening portion 40A of the metal shell 40. The center electrode 10 is electrically connected to an external power source via the terminal electrode 30 disposed on the rear end side.

Figure 2:
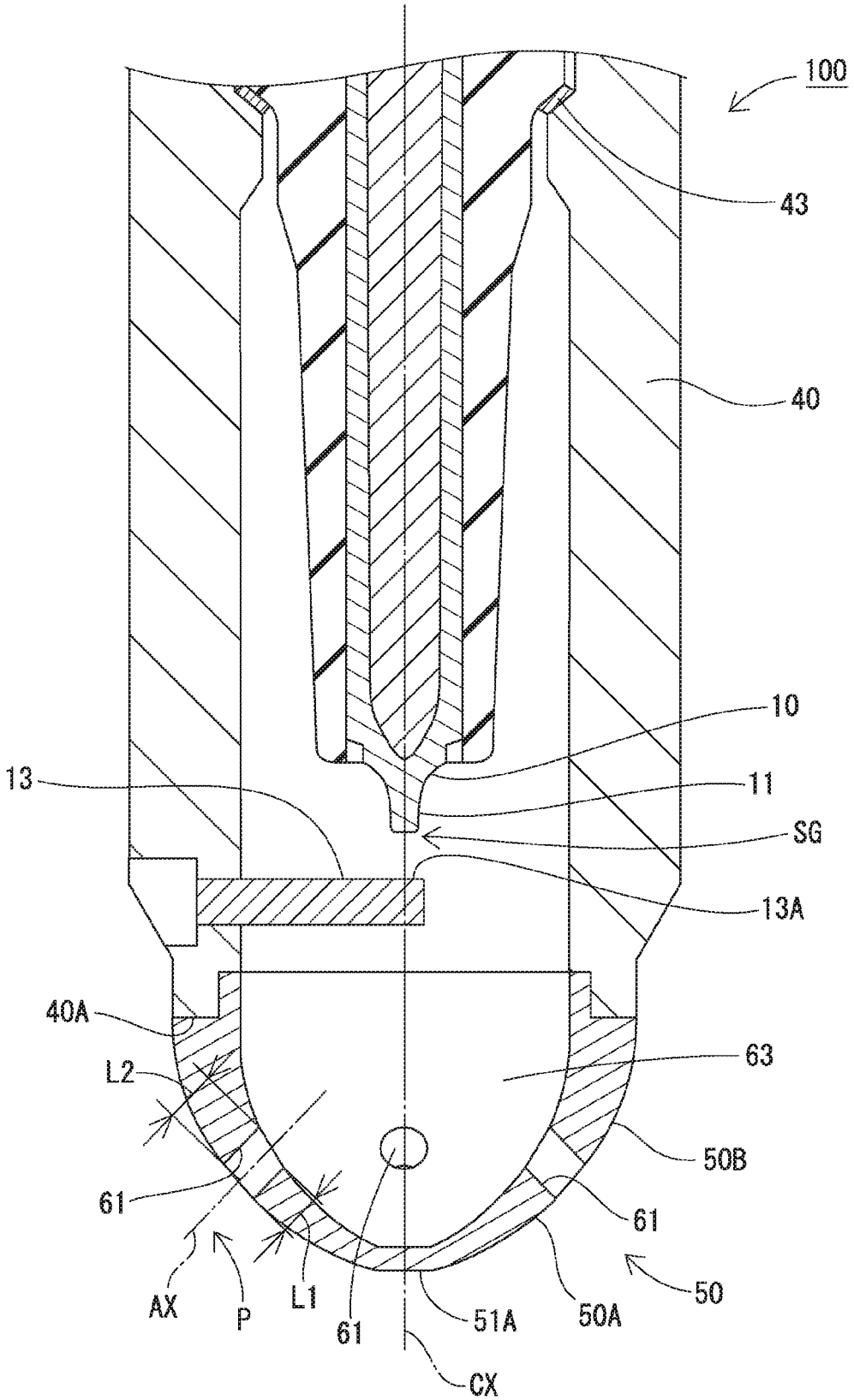
FIG. 2 is a partially-enlarged cross-sectional view of the spark plug according to a first embodiment.

The ground electrode 13 is a rod-shaped electrode extending from a position slightly on the rear end side (upper side in the drawing) with respect to the front-end-side opening portion 40A of the metal shell 40 toward a position slightly on the front end side (lower side in the drawing) with respect to the front end portion 11 of the center electrode 10. Specifically, the ground electrode 13 is connected to the metal shell 40 at a position slightly on the rear end side (upper side in the drawing) with respect to the front-end-side opening portion 40A. The ground electrode 13 extends up to the front of the front end portion 11 of the center electrode 10. As illustrated in FIG. 2, the ground electrode 13 includes a facing portion 13A facing the front end portion 11 of the center electrode 10. A discharge gap SG is formed between the facing portion 13A of the ground electrode 13 and the front end portion 11 of the center electrode 10.

The insulator 20 is a cylindrical member including an axial hole 21 penetrating through the center thereof. The insulator 20 is constituted by, for example, a ceramic sintered body made of alumina or aluminum nitride. On the front end side of the axial hole 21 of the insulator 20, the center electrode 10 is accommodated with the front end portion 11 thereof being exposed. On the rear end side of the axial hole 21, the terminal electrode 30, which is a shaft-shaped electrode member, is held. A rear end portion 31 of the terminal electrode 30 extends out from a rear end opening portion 22 of the insulator 20 so as to be connectable with the external power source. The center electrode 10 and the terminal electrode 30 are electrically connected to each other via a resistor 35 that is held between glass sealing materials in order to suppress generation of radio interference noise when a spark discharge occurs. The center axis of the insulator 20 is coincident with the center axial line CX of the spark plug 100.

The metal shell 40 is a substantially cylindrical metal member including a cylinder hole 41 at the center thereof. The metal shell 40 is constituted of, for example, carbon steel. The center axis of the metal shell 40 is coincident with the center axial line CX of the spark plug 100. As described above, the ground electrode 13 is attached near the front-end-side opening portion 404 of the metal shell 40. A packing 43 is disposed between a diameter reduced portion inside the metal shell 40 and the insulator 20. The packing 43 is constituted by, for example, a metal material softer than a metal material constituting the metal shell 40.

The spark plug 100 includes a cover portion 50. The cover portion 50 has a dome shape. The cover portion 50 is constituted of, for example, stainless steel, nickel-based alloy, or copper-based alloy. The cover portion 50 is annularly joined to the front end of the molal shell 40 (more specifically, the front-end-side opening portion 40A). As illustrated in FIG. 2, the cover portion 50 covers the front end portion 11 of the center electrode 10 and the facing portion 13A of the ground electrode 13 from the front side. The space surrounded by the cover portion 50 is a pre-chamber space (pre-chamber) 63. The cover portion 50 has its thickness gradually decreasing from the rear end side toward an apex 51A.

As illustrated in FIG. 2, the cover portion 50 has multiple injection holes 61 on the rear end side of the apex 51A. The cover portion 50 has, for example, four injection holes 61. Each of the injection holes 61 is a substantially cylindrical through-hole. Each of the injection holes 61 has its center axial line AX inclined with respect to the center axial line CX of the spark plug 100. The multiple injection holes 61 are positioned on a virtual circumference centered on the center axial line CX of the spark plug 100. The multiple injection holes 61 are arranged at equal intervals on the virtual circumference.

The pre-chamber space 63, which is a space covered with the cover portion 50, functions as an ignition chamber, and communicates with the combustion chamber via the injection holes 61. When the inner peripheral surface of each of the four injection holes 61 of the cover portion 50 is cut by a plane P, the portion inside the injection hole 61 on the front end side with respect to the plane P has a smaller surface area than the portion inside the injection hole 61 on the rear end side. Here, the plane P is a plane that passes the center axial line AX of the injection hole 61 and is orthogonal to a plane including the center axial line CX of the spark plug 100 and the center axial line AX of the injection hole 61 (cross section of the spark plug 100 illustrated in FIG. 2). In other words, when the inner peripheral surface of the injection hole 61 is cut by the plane including the center axial line CX of the spark plug 100 and the center axial line AX of the injection hole 61 (cross section of the spark plug 100 illustrated in FIG. 2), the front-end-side cross-sectional edge of the inner peripheral surface of the injection hole 61 has a length L1, which is smaller than a length L2 of the rear-end-side cross-sectional edge. Thus, in the cover portion 50, a portion 50A on the front end side with respect to the injection holes 61 is thinner than a portion 50B on the rear end side with respect to the injection holes 61. In the spark plug 100 with this structure, heat is more likely to be guided to be dissipated from the front end side of the cover portion 50 to the rear end side in an environment where pre-ignition easily occurs. Therefore, temperature does not rise excessively, so that pre-ignition can be prevented.

In the spark plug 100 according to the first embodiment, the total area A ($mm^2$) of the inner peripheral surfaces of the four injection holes 61 and the thermal conductivity B (W/mK) of the material of the cover portion 50 satisfy the following formulae (1), (3), and (4):

$$10<A\times B<4000 \quad \text{formula (1)},$$

$$0.7\leq A\leq 18.5 \quad \text{formula (3), and}$$

$$13\leq B\leq 372 \quad \text{formula (4)}.$$

In this spark plug 100, as the total area A ($mm^2$) of the inner peripheral surfaces of the four injection holes 61 increases, heat in the pre-chamber space 63 is more likely to be transferred from the cover portion 50 toward the metal shell 40 side. As the thermal conductivity B (W/mK) of the material of the cover portion 50 increases, heat in the pre-chamber space 63 is more likely to be transferred from the cover portion 50 toward the metal shell 40 side. Therefore, when A×B is set to be smaller than 4000, heat is not excessively transferred from the cover portion 50 toward the metal shell 40 side, so that misfires due to lowering of temperature of the cover portion 50 can be prevented. In addition, when Ax B is set to be larger than 10, heat transfer from the cover portion 50 toward the metal shell 40 side is facilitated, so that pre-ignition can be prevented.

In the spark plug 100 according to the first embodiment, preferably, the total area A ($mm^2$) of the inner peripheral surfaces of the four injection holes 61 and the thermal conductivity B (W/mK) of the material of the cover portion 50 satisfy the following formula (2):

$$20<A\times B<2400 \quad \text{formula (2).}$$

In this spark plug 100, when the product of A×B is set to be larger than 20, where A is the total area ($mm^2$) of the inner peripheral surfaces of the four injection holes 61 and B is the thermal conductivity (W/mK) of the material of the cover portion, heat transfer from the cover portion 50 toward the metal shell 40 side is further facilitated, so that pre-ignition can be more efficiently prevented.

Second Embodiment

A spark plug 200 according to a second embodiment will now be described with reference to FIG. 3. The spark plug 200 according to the second embodiment differs from the spark plug 100 according to the first embodiment in terms of the structure of a cover portion 250. The other configurations are substantially the same as those in the spark plug 100 according to the first embodiment. Components having substantially the same configurations are thus driven the same reference signs, and description of structures, actions, and effects thereof is omitted.

Figure 3:
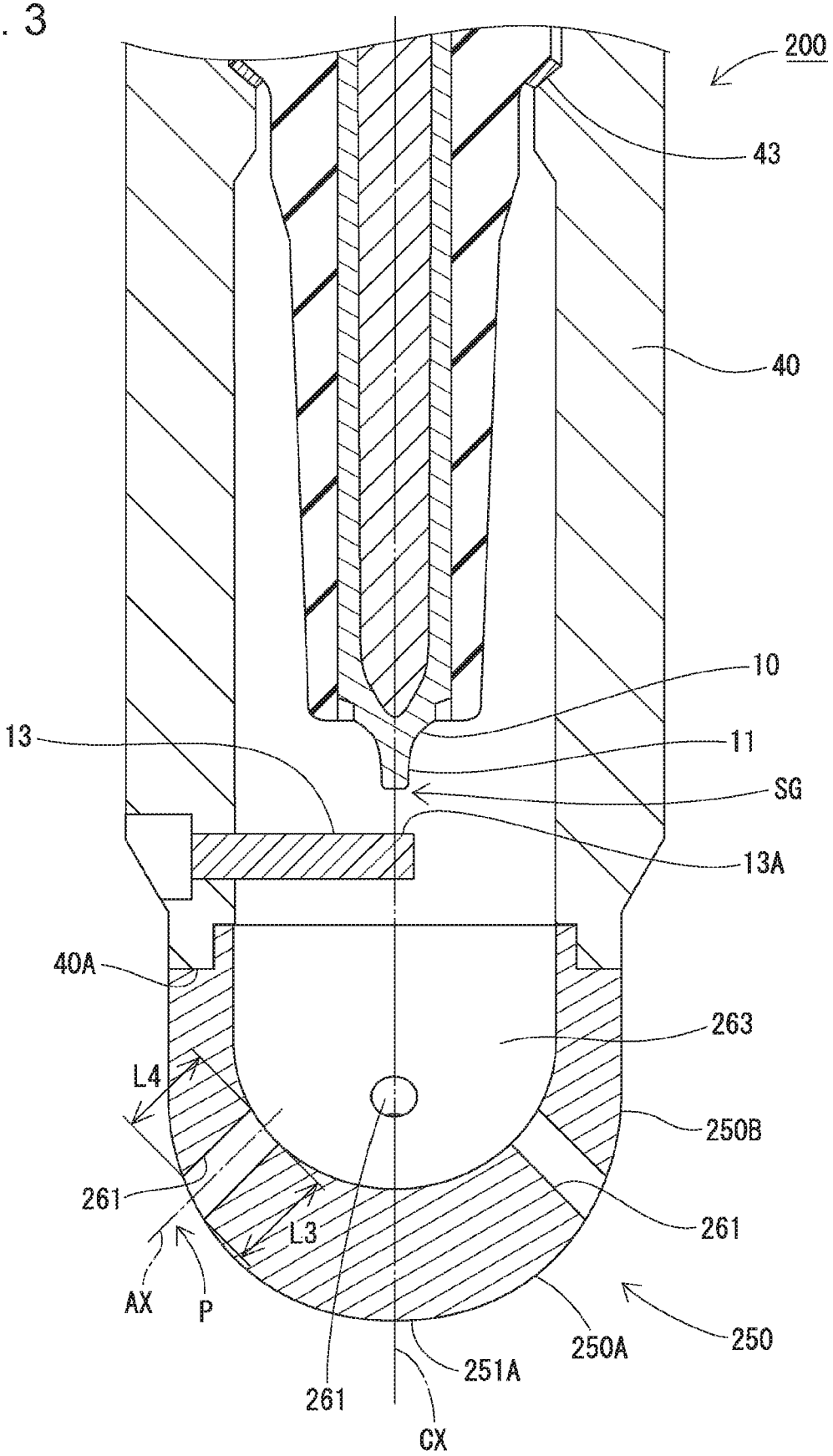
FIG. 3 is a partially-enlarged cross-sectional view of a spark plug according to a second embodiment.

As illustrated in FIG. 3, the cover portion 250 has a dome shape. The cover portion 250 is annularly joined to the front end of the metal shell 40 (more specifically, the front-end-side opening portion 40A). The cover portion 250 covers the front end portion 11 of the center electrode 10 and the facing portion 13A of the ground electrode 13 from the front side. The space surrounded by the cover portion 250 is a pre-chamber space 263. The cover portion 250 has its thickness gradually increasing from the rear end side toward an apex 251A.

As illustrated in FIG. 3, the cover portion 250 has multiple injection holes 261 on the rear end side of the apex 251A. The cover portion 250 has, for example, four injection holes. Each of the injection holes 261 is a substantially cylindrical through-hole. Each of the injection holes 261 has its center axial line AX inclined with respect to the center axial line CX of the spark plug 200. The multiple injection holes 261 are positioned on a virtual circumference centered on the center axial line CX of the spark plug 200. The multiple injection holes 261 are arranged at equal intervals on the virtual circumference.

The pre-chamber space 263, which is a space covered with the cover portion 250, communicates with the combustion chamber through the injection holes 261. When the inner peripheral surface of one injection hole 261 of the cover portion 250 is cut by a plane P, the portion inside the injection hole 261 on the front end side with respect to the plane P has a larger surface area than the portion inside the injection hole 261 on the rear end side with respect to the plane P. Here, the plane P is a plane that passes the center axial line AX of the injection hole 261 and is orthogonal to the plane including the center axial line CX of the spark plug 200 and the center axial line AX of the injection hole 261 (cross section of the spark plug 200 illustrated in FIG. 3). In other words, as illustrated in FIG. 3, when the inner peripheral surface of the injection hole 261 is cut by the plane including the center axial line CX of the spark plug 200 and the center axial line AX of the injection hole 261 (cross section of the spark plug 200 illustrated in FIG. 3), the front-end-side cross-sectional edge of the inner peripheral surface of the injection hole 261 has a length L3, which is larger than a length L4 of the rear-end-side cross-sectional edge. Thus, in the cover portion 250, a portion 250A on the front end side with respect to the injection holes 261 is thicker than a portion 250B on the rear end side with respect to the injection holes 261. In the spark plug 200 with this structure, heat is more likely to be guided to be collected to the front end side of the cover portion 250 in an environment where misfires easily occur, and thus temperature is not easily lowered, so that misfires can be prevented.

In the spark plug 200 according to the second embodiment, as in the case of the spark plug 100 according to the first embodiment, the total area. A ($mm^2$) of the inner peripheral surfaces of the four injection holes 261 and the thermal conductivity B (W/mK) of the material of the cover portion 250 satisfy the above formula (1) ($10<A\times B<4000$). Thus, the spark plug 200 achieves the same effects as the spark plug 100 according to the first embodiment.

As in the case of the spark plug 100 according to the first embodiment, in the spark plug 200 according to the second embodiment, preferably, the total area A. ($mm^2$) of the inner peripheral surfaces of the four injection holes 261 and the thermal conductivity B (W/mK) of the material of the cover portion 250 satisfy the formula (2) ($20<A\times B<2400$). Thus, the spark plug 200 achieves the same effects as the spark plug 100 according to the first embodiment.

EXAMPLES

The present invention will be more specifically described below using examples.

1. Experiment (Experiment Corresponding to First Embodiment)

(1) Method of Experiment (1.1) Examples

Samples of the spark plug 100 illustrated in FIGS. 1 and 2 were used herein. Table 1, below, shows the detailed conditions. The spark plug 100 satisfies the requirements of the first embodiment. In Table 1, each experiment example is denoted with "No.". Nos. 2 to 28 in Table 1 are examples.

(1.2) Comparative Examples

Samples of a spark plug having a structure different from that of the spark plug 100 illustrated in FIGS. 1 and 2 (different in total area A ($mm^2$) of the inner peripheral surfaces of the injection holes or thermal conductivity B (W/mK) of the material of the cover portion) were used herein. Table 1, below, shows the detailed conditions. This spark plug does not satisfy the requirements of the first embodiment. Numbers marked with an asterisk "*", like "1*" in Table 1, denote that they are comparative examples. Specifically, Nos. 1, 29, and 30 in Table 1 are comparative examples.

(2) Method for Evaluation (2.1) Measurement of Total Area a ($mm^2$) of Inner Peripheral Surfaces of Injection Holes Using an X ray computed tomography (CT) scanner, the cover portion of each sample was scanned under the conditions of a tube voltage of 120 kV and a tube current of 140 μA. A three-dimensional image was manufactured from the scanning result for each cover portion, and the total area A ($mm^2$) of the inner peripheral surfaces of the four injection holes was measured.

(2.2) Pre-Ignition Resistance Evaluation Test

Each sample underwent a pre-ignition resistance evaluation test. The summary of the pre-ignition resistance evaluation test is as follows. Each sample was mounted on an in-line four-cylinder naturally aspirated engine with a displacement of 1.3 L, and the engine was operated 1000 cycles of a series of processes on full throttle (6000 rpm) at an ignition angle (crank angle) of a predetermined initial value. During the engine operation, whether pre-ignition occurs was checked. When pre-ignition occurred, the ignition angle at that time was specified as a pre-ignition occurrence angle. When no pre-ignition occurred, the ignition angle was advanced by one degree, and the engine was activated again on full throttle to check whether pre-ignition occurs. This operation was performed repeatedly until pre-ignition occurs to specify the pre-ignition occurrence angle of each sample. Similarly, the pre-ignition occurrence angle of a reference spark plug (a genuine spark plug installed on a test engine) was specified. Then, the difference between the pre-ignition occurrence angle of the reference spark plug and the pre-ignition occurrence angle of each sample was calculated. When the pre-ignition occurrence angle is on more advanced side with respect to the reference spark plug, the spark plug is evaluated as having higher pre-ignition resistance. The pre-ignition occurrence angle of each sample with respect to that of the reference spark plug was evaluated based on the following standards, and each experiment example was given an evaluation score. The results are shown in the column "pre-ignition resistance" in Table 1.

<Evaluation of Pre-Ignition Resistance>

Each sample was evaluated with the following three grades. Higher evaluation scores represent higher pre-ignition resistance.

Evaluation Score:

3: Advanced by 5° C.A or more with respect to the reference spark plug

1: Advanced by 2° C.A or more and less than 5° C.A with respect to the reference spark plug 0: Lagged or advanced by less than 2° C.A with respect to the reference spark plug (2.3) Misfire Resistance Test Each sample underwent a misfire resistance evaluation test. The summary of the misfire resistance evaluation test is as follows. Each sample was mounted on an in-line four-cylinder direct-injection turbocharger engine with a displacement of 1.6 L, and the engine was operated 1000 cycles under the conditions of 2000 rpm and an intake pressure of 1000 kPa to measure the misfire rate. Spark plugs having a smaller misfire rate are evaluated as having higher misfire resistance (ignitability). The misfire rate of each sample was evaluated based on the following standards, and each experiment example was given an evaluation score. The results are shown in the column "misfire resistance" in Table 1.

<Evaluation of Misfire Resistance>

Each sample was evaluated with the following three grades. Higher evaluation scores represent higher misfire resistance.

Evaluation Score:

3: Misfire rate of lower than 1%

1: Misfire rate of 1% or higher and lower than 3%

0: Misfire rate of 3% or higher (2.4) Overall Evaluation

Based on the total score of the evaluation score for the pre-ignition resistance and the evaluation score for the misfire resistance, overall evaluation was made for each sample. Higher total scores are evaluated as being more preferable in both pre-ignition resistance and misfire resistance. The overall evaluation of a sample with the total score of 6 is denoted with "Excellent", the overall evaluation of a sample with the total score of 4 is denoted with "Good", and the overall evaluation of a sample with the total score of 3 is denoted with "Poor". The results are shown in the column "overall evaluation" in Table 1,

TABLE 1

| No. | A: Total area of inner peripheral surfaces of injection holes ($mm^2$) | B: Thermal conductivity of cover portion (W/mK) | A × B | Pre-ignition resistance | Misfire resistance | | Overall evaluation |
|---|---|---|---|---|---|---|---|
| 1* | 0.7 | 13 | 9.1 | 0 | 3 | 3 | Poor |
| 2 | 1.5 | 13 | 19.5 | 1 | 3 | 4 | Good |
| 3 | 2.2 | 13 | 28.6 | 3 | 3 | 6 | Excellent |
| 4 | 4.4 | 13 | 57.2 | 3 | 3 | 6 | Excellent |
| 5 | 11.2 | 13 | 145.6 | 3 | 3 | 6 | Excellent |
| 6 | 18.5 | 13 | 240.5 | 3 | 3 | 6 | Excellent |
| 7 | 0.7 | 26 | 18.2 | 1 | 3 | 4 | Good |
| 8 | 1.5 | 26 | 39.0 | 3 | 3 | 6 | Excellent |
| 9 | 2.2 | 26 | 57.2 | 3 | 3 | 6 | Excellent |
| 10 | 4.4 | 26 | 114.4 | 3 | 3 | 6 | Excellent |
| 11 | 11.2 | 26 | 291.2 | 3 | 3 | 6 | Excellent |
| 12 | 18.5 | 26 | 481.0 | 3 | 3 | 6 | Excellent |
| 13 | 0.7 | 53 | 37.1 | 3 | 3 | 6 | Excellent |

TABLE 1-continued

| No. | A: Total area of inner peripheral surfaces of injection holes ($mm^2$) | B: Thermal conductivity of cover portion (W/mK) | A × B | Pre-ignition resistance | Misfire resistance | | Overall evaluation |
|---|---|---|---|---|---|---|---|
| 14 | 1.5 | 53 | 79.5 | 3 | 3 | 6 | Excellent |
| 15 | 2.2 | 53 | 116.6 | 3 | 3 | 6 | Excellent |
| 16 | 4.4 | 53 | 233.2 | 3 | 3 | 6 | Excellent |
| 17 | 11.2 | 53 | 593.6 | 3 | 3 | 6 | Excellent |
| 18 | 18.5 | 53 | 980.5 | 3 | 3 | 6 | Excellent |
| 19 | 0.7 | 130 | 91.0 | 3 | 3 | 6 | Excellent |
| 20 | 1.5 | 130 | 195.0 | 3 | 3 | 6 | Excellent |
| 21 | 2.2 | 130 | 286.0 | 3 | 3 | 6 | Excellent |
| 22 | 4.4 | 130 | 572.0 | 3 | 3 | 6 | Excellent |
| 23 | 11.2 | 130 | 1456.0 | 3 | 3 | 6 | Excellent |
| 24 | 18.5 | 130 | 2405.0 | 3 | 1 | 4 | Good |
| 25 | 0.7 | 372 | 260.4 | 3 | 3 | 6 | Excellent |
| 26 | 1.5 | 372 | 558.0 | 3 | 3 | 6 | Excellent |
| 27 | 2.2 | 372 | 818.4 | 3 | 3 | 6 | Excellent |
| 28 | 4.4 | 372 | 1636.8 | 3 | 3 | 6 | Excellent |
| 29* | 11.2 | 372 | 4166.4 | 3 | 0 | 3 | Poor |
| 30* | 18.5 | 372 | 6882.0 | 3 | 0 | 3 | Poor |

(3) Evaluation Results

The experiment example 1 (comparative example) was rated 3 in overall score, with a product A×B of 9.1, where A is the total area ($mm^2$) of the inner peripheral surfaces of the injection holes and B is the thermal conductivity (W/mK) of the material of the cover portion. The experiment example 29 (comparative example) was rated 3 in overall score, with a product A×B of 4166.4. The experiment example 30 (comparative example) was rated 3 in overall score, with a product A×B of 6882.0. On the other hand, the experiment examples 2 to 28 (examples) were rated 4 or 6 in overall scores with a product satisfying $10<A\times B<4000$. Thus, the examples satisfying the formula (1) ($10<A\times B<4000$) had suppressed both pre-ignition and misfires as compared with the comparative examples.

The experiment example 1 (comparative example) had a product A×B of 9.1, and rated 0 in pre-ignition resistance evaluation score. The experiment example 2 (example) had a product A×B of 19.5, and rated 1 in pre-ignition resistance evaluation score. The experiment example 7 (example) had a product A×B of 18.2, and rated 1 in pre-ignition resistance evaluation score. On the other hand, the experiment examples 3 to 6, 8 to 23, and 25 to 28 (examples) had a product satisfying $20<A\times B<2400$, and rated 3 in pre-ignition resistance evaluation score. Thus, the experiment examples 3 to 6, 8 to 23, and 25 to 28 satisfying the formula (2) ($20<A\times B<2400$) had further suppressed pre-ignition.

Other Embodiments (Modifications)

The present invention is not limited to the above embodiments, and may be embodied in various different forms within the scope not departing from the gist of the invention.

(1) In the above embodiments, the cover portion has a specific shape, but the shape is changeable as appropriate. The cover portion may have, for example, a circular cylindrical shape, a quadrangular box shape, or a conical shape.

(2) In the above embodiments, a spark plug having a specific number of injection holes is described as an example, but the number of injection holes is not limited to a specific one and changeable as appropriate. The arrangement of the injection holes and the penetrating direction of the injection hole are also changeable as appropriate.

What is claimed is:

1. A spark plug, comprising:

a center electrode;

aground electrode that includes a facing portion facing a front end portion of the center electrode and forms a discharge gap between the facing portion and the front end portion of the center electrode;

a cylindrical insulator that accommodates the center electrode therein with the front end portion of the center electrode being exposed from a front end of the insulator;

a metal shell that accommodates the insulator therein; and a cover portion that covers, from a front end side of the spark plug, the front end portion of the center electrode and the facing portion of the ground electrode to form a pre-chamber, the cover portion including injection holes that are through-holes, wherein a total area A ($mm^2$) of inner peripheral surfaces of the injection holes and a thermal conductivity B (W/mK) of a material of the cover portion satisfy a formula (1):

$$10<A\times B<4000.$$

2. The spark plug according to claim 1, wherein the total area A ($mm^2$) and the thermal conductivity B (W/mK) satisfy a formula (2):

$$20<A\times B<2400.$$

3. The spark plug according to claim 1, wherein, when the inner peripheral surface of at least one of the injection holes having a center axial line inclined with respect to an axial line of the spark plug is cut by a plane P, a portion inside the injection hole on the front end side with respect to the plane P has a smaller surface area than a portion inside the injection hole on the rear end side with respect to the plane P, where the plane P is a plane that passes the center axial line of the injection hole and is orthogonal to a plane including the axial line of the spark plug and the center axial line of the injection hole.

4. The spark plug according to claim 1, wherein, when the inner peripheral surface of at least one of the injection holes having a center axial line inclined with respect to an axial line of the spark plug is cut by a plane P, a portion inside the injection hole on the front end side with respect to the plane P has a larger surface area than a portion inside the injection hole on the rear end side with respect to the plane P, where the plane P is a plane that passes the center axial line of the injection hole and is orthogonal to a plane including the axial line of the spark plug and the center axial line of the injection hole.

5. The spark plug according to claim 2, wherein, when the inner peripheral surface of at least one of the injection holes having a center axial line inclined with respect to an axial line of the spark plug is cut by a plane P, a portion inside the injection hole on the front end side with respect to the plane P has a smaller surface area than a portion inside the injection hole on the rear end side with respect to the plane P, where the plane P is a plane that passes the center axial line of the injection hole and is orthogonal to a plane including the axial line of the spark plug and the center axial line of the injection hole.

6. The spark plug according to claim 2, wherein, when the inner peripheral surface of at least one of the injection holes having a center axial line inclined with respect to an axial line of the spark plug is cut by a plane P, a portion inside the injection hole on the front end side with respect to the plane P has a larger surface area than a portion inside the injection hole on the rear end side with respect to the plane P, where the plane P is a plane that passes the center axial line of the injection hole and is orthogonal to a plane including the axial line of the spark plug and the center axial line of the injection hole.

* * * * *